US006497056B1

(12) United States Patent
McGoveran

(10) Patent No.: US 6,497,056 B1
(45) Date of Patent: Dec. 24, 2002

(54) PERSONALIZING PATTERNS FOR FOOTWEAR SOLES

(76) Inventor: David O. McGoveran, 6221A Graham Hill Rd., Suite #8001, Boulder Creek, CA (US) 95018

( * ) Notice: Subject to any disclaimer, the term of this patent is extended or adjusted under 35 U.S.C. 154(b) by 0 days.

(21) Appl. No.: 09/262,470

(22) Filed: Mar. 4, 1999

(51) Int. Cl.[7] ..... A43B 3/00
(52) U.S. Cl. ..... 36/1
(58) Field of Search ..... 12/142, 146; 36/1, 36/3 R, 11.5, 30 R, 112; 264/1, 37, 244, 400; 345/420, 433, 619, 629, 634, 641; 425/119

(56) References Cited

U.S. PATENT DOCUMENTS 4,050,167 A * 9/1977 Senter ..... 36/32 R
4,958,446 A * 9/1990 Brown ..... 36/11.5
5,193,240 A * 3/1993 Salpietro ..... 12/146 B
5,331,753 A * 7/1994 Rodibaugh ..... 36/36
5,586,354 A * 12/1996 Chi ..... 12/146 BR
5,586,501 A * 12/1996 Burguera et al. ..... 104/368
5,830,529 A * 11/1998 Ross ..... 427/152

* cited by examiner

*Primary Examiner*—Jeffery Brier
*Assistant Examiner*—G. F. Cunningham
(74) *Attorney, Agent, or Firm*—George S. Cole

(57) ABSTRACT

A method for creating one or more footwear soles that will print out with each step on a malleable surface (such as sand) or an imprintable surface (such as a sidewalk) a pattern (which may include therein an image, text, and their combination), wherein the pattern to be printed is personalized to each sole's individual owner according to the owner's specification of the pattern.

19 Claims, 3 Drawing Sheets

PERSONALIZING PATTERNS FOR FOOTWEAR SOLES

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

Mass production of identical footwear does not create footwear that could provide personalized patterns from the owner's use of the footwear on sand, mud, or other impressible surfaces, or on a sidewalk for footwear with internal ink(s). Handcrafted footwear having soles with individual patterns have been only available to those with access to craftsmen capable of transforming a description or viewed image into a carved sole. This embodiment of the invention makes feasible mass customization that combines pre-made footwear soles with individually selected and separable patterns to produce one-of-a-kind footwear without requiring handcraft work on each such sole.

2. Description of the Related Art

Footwear, and the patterns that a sole makes, are known as a means of distinguishing one individual from another; in American literature, at least, this has been described from James Fenimore Cooper's time onwards. Hand-crafted footwear soles were also one of the earliest media of advertising. Classicists acknowledge that one of Athens' hetaerae had the obverse form of the Greek phrase "Follow Me" carved into the sole of her sandals (an examplar class of footwear), producing in the dusty and sandy streets of Periclean Athens a clear trail for literate (and thus, presumably well-off), potential clients to follow to her doorstep.

Present-day cobblers can still provide personalized, hand-designed and hand-carved soles. Mass manufacturers have provided firm names and distinctive graphical patterns on footwear soles, broadly advertising their wares through mass-production. Neither have devised a means for mass-customization of footwear soles whose functional form is differentiated by the individual customer's requested design being incorporated as a pattern on the bottom surface of a sole. Producing footwear soles with personalized patterns specific to an ordering individual has remained a handcraft art to this day, though the material of which the sole is composed now ranges from traditional leather through rubber, old tires, and foamed light plastics. The mass manufacturers have lacked the flexibility; and the handcrafters either the skill to attain the desired graphical image or the productivity to rapidly alter the soles of a large number of sandals or other footwear.

SUMMARY

Three-dimensional output devices now exist that can produce from a graphical image an output with that image's form as its topmost portion. The desired image of the pattern which is to be printed by the footwear sole is produced as such an output, which is then applied to the bottom of the footwear sole in such a fashion as to produce thereupon the mirror image in the bottom of the footwear sole, so that thereafter, whenever the footwear sole is placed upon an impressionable surface, the image of the desired pattern is formed in such impressionable surface.

DESCRIPTION OF THE SEVERAL VIEWS OF THE DRAWINGS

This embodiment of the invention will be better understood with reference to drawings illustrating a preferred embodiment, in which:

In FIG. 1 the pattern is the capital letter "B" followed by the small letter "a"; however, any combination of alphanumeric symbols or abstract graphical pattern could be on the output block.

DETAILED DESCRIPTION OF THE INVENTION

Figure 1:
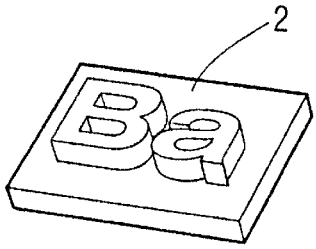
FIG. 1 shows a block of a microwave-absorbing material placed on top of a base pad (2). The topmost portion thus becomes a three-dimensional model of the image that is to be formed in the impressionable surface on the footwear sole's bottom, printing face.
Figure 2:
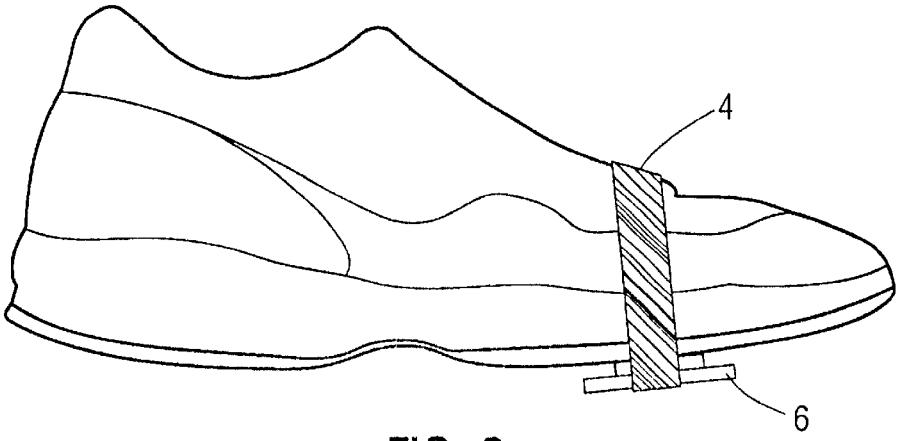
FIG. 2 shows the block of microwave-absorbing material on top of the base pad and both together (6) attached by a strap of non-microwave absorbing material (4) to a pre-made footwear, such that the microwave-absorbing material's printing face is held against the bottom face of the footwear's sole.
Figure 3:
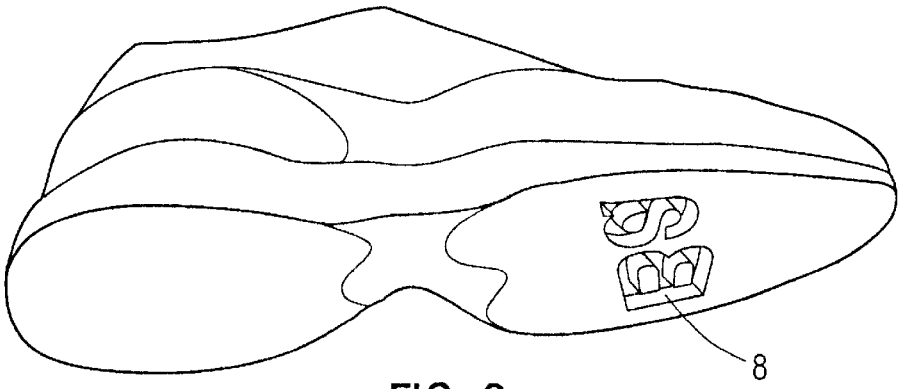
FIG. 3 shows the bottom face of the footwear's sole after the pattern has been impressed, with the mirror image of the desired pattern (8) now embodied in the bottom face.
Figure 4:
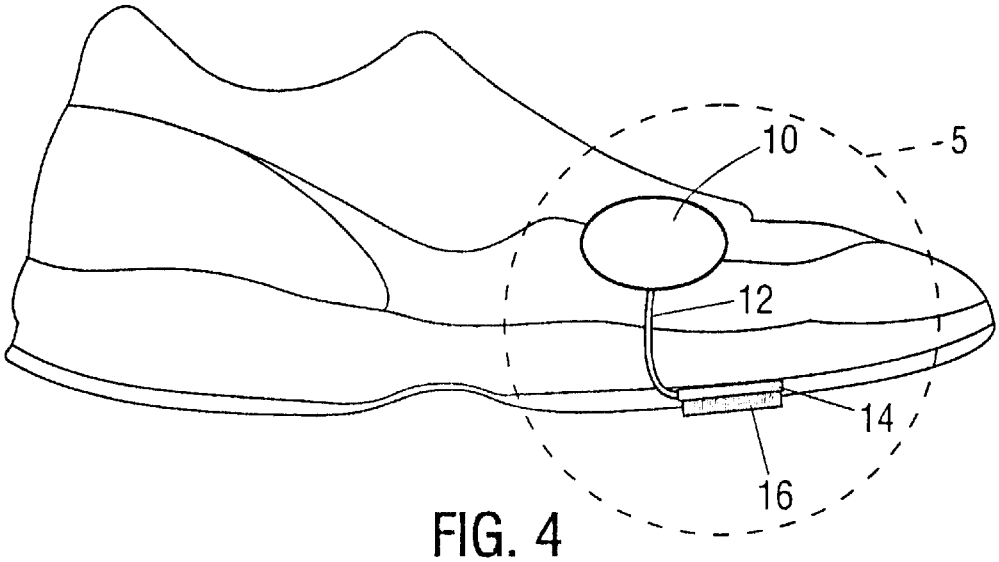
FIG. 4 and FIG. 5 (a close-up view of only a portion of the footwear) shows a variation of the invention in which the footwear has a reservoir (10) for ink or other colorizing fluid, a connecting tube (12) to a stamp pad (14) separated from the outer face of the bottom sole by a printface (16) into which the pattern will be formed such that after forming the pattern will allow the stamp pad to make contact with the surface, allowing the ink to be stamped on the surface.
Figure 5:
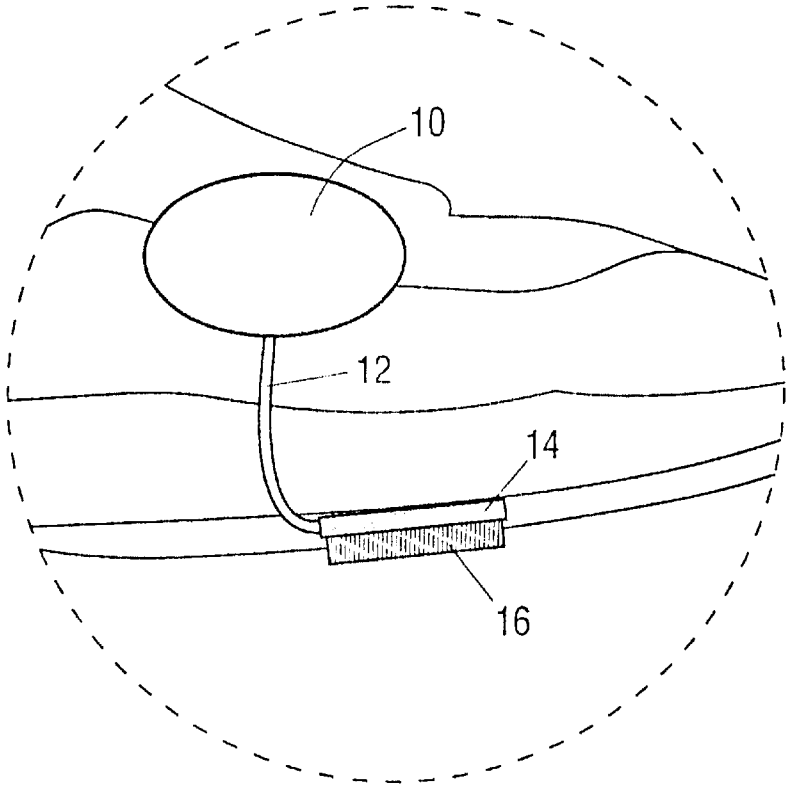
Figure 6:
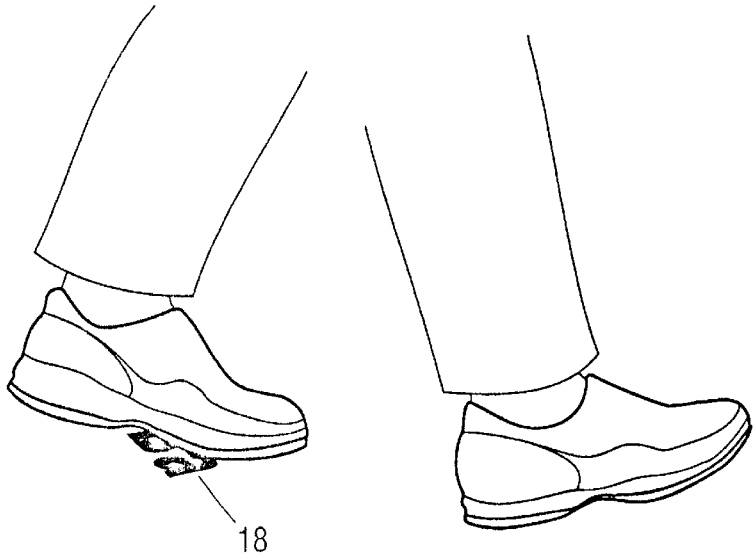
FIG. 6 is an illustration of the owner of the customized footwear producing the desired individual pattern (18) as he or she walks along an impressionable surface.

Producing a pattern on an impressionable surface requires creation of the mirror image of that pattern on a printing face which is then applied to the impressionable surface. That mirror image can be produced by applying the image of the pattern desired to the printing face in such fashion as to form in the printing face that pattern.

Previously, the bottom face of the sole of any particular, individual piece of footwear could have a mirror image of a pattern either carved into it by a human craftsman capable of mentally transforming the desired pattern into its mirror image and rendering that mirror image in the bottom face of the footwear sole. Alternatively, the bottom face of the soles of an entire production run of footwear could be made with a uniform, common pattern selected by the manufacturer. Such a method was disclosed for disposable sandals in Brown, James, U.S. Pat. No. 4,958,446; but that patent was for the sandal and, by extension, to an entire production run, rather than for a method for mass customization from previously mass-produced and identical footwear. There is no requirement that the sole have a preexisting cavity for an insert, or use a plastic film, as in Kuan-Jen Chi, U.S. Pat. No. 5,586,354. Nor is this method aimed at producing footwear with an empty chamber visible through a transparent material, as in Salpietro, Francisco, U.S. Pat. No. 5,193,240.

Now there are output devices that can produce a three-dimensional pattern from a graphical image. There are also a number of materials which can absorb a proportion of microwaves and more rapidly heat up than the materials comprising certain footwear soles. Combining these two creates a method of producing individually customized footwear whose sole's bottom face will impress a pattern unique to each customer on an impressionable surface.

In an alternate variation of this invention, a computer with temporary memory, long-term memory, an input device, and graphical processing capability is hooked up to an output device. The computer is used to finalize a desired graphical image; this can be by have the user find and select an initial image from the long-term memory where a library of images may be stored, or use the input device to create an image in the computer's temporary memory or scan an image in through a scanner. The designer, possibly the individual owner, alters the initial image in the temporary memory using the graphical processing capability of the computer, possibly through a generally available, computer graphic processing software program (e.g. Canvas®, Photoshop®, MacPaint®, or various 'freeware' graphic processing programs), to create the desired graphical image. This image can be stored as a matrix representation whose dimensions can include length, width, depth, and color, and can be expressed by the strings of individual 1's and 0's (bits) stored in the computer's memory. These bit-map images can in turn become directions to an output device, such as a bit-map printer or a multi-pin array impact device capable of impressing into a temporarily malleable surface, the image stored in the computer, where the bits corresponding to the length and width govern which pins are actuated, and those bits corresponding to either depth or color govern respectively how deeply the pins are driven, or whether additional processing (such as color tattooing) for a particular bit location is indicated. The computer then uses its graphical processing capability to create the pattern's mirror image, and this mirror image is directed to the output device, which is then used to create that mirror image in the footwear sole(s) to be later individually treated.

Best Method: The image to be applied to the bottom face of a footwear sole to produce the printing mirror image therein is formed out into a block of a microwave-absorbing material. The microwave-absorbing material block is then placed on top of a base pad made of a non-microwave absorbing material, the footwear is placed atop the microwave absorbing output with the bottom face of the footwear sole contacting the microwave absorbing material block so that the footwear's own weight holds it down on top of the microwave-absorbing material block. The combined footwear, microwave-absorbing material block, and base pad are then put into a microwave, which is turned on for a short period, heating the microwave absorbing material block. The weight of the footwear and the heat of the microwave absorbing material block together produce a permanent mirror image of the desired pattern in the bottom face of the sole of the footwear, which will thereafter produce the desired graphical image in any temporarily malleable surface (e.g. sand, mud) that the footwear owner strides upon with that sole.

In one variation, a computer with graphical processing capability takes an image (from its long-term memory, an image scanner, or a graphic processing software program file) and places that image into its temporary memory. Then the user first uses the computer's graphical processing capability and a graphic processing software to finalize the desired graphical image, and then expresses that desired graphical image's image via an output device, producing the microwave absorbing material block which will be applied to the bottom face of the footwear sole as described above.

In a second variation, the microwave-absorbing material is output as one or more blocks. Such blocks (some of which may come from previous outputs) are then combined to form the complete pattern, and the combined block is then applied to the bottom face of the footwear sole as described above.

I claim:

1. A method for producing personalized patterns on an ordinary footwear sole having a bottom face, comprising:

step for producing an output of an image, and step for applying said output to the bottom face of the ordinary footwear sole to create therein an inverse of said image.

2. A device for producing personalized patterns on an ordinary footwear sole having a bottom face, comprising:

means for producing an output of an image, and means for applying said output to the bottom face of the ordinary footwear sole to create therein an inverse of said image.

3. A method as in claim 1, wherein:

the step for producing an output of an image comprises a computer with graphic processing capability and an output device capable of producing a three-dimensional output of a graphic image.

4. A device as in claim 2, wherein:

the means for producing an output of an image comprises a computer with graphic processing capability and an output device capable of producing a three-dimensional output of a graphic image.

5. A method as in claim 1, further comprising:

an input step for a graphical image;

memory for storing a graphical image; and, an editing means for transforming one graphical image into another.

6. A device as in claim 2, further comprising:

an input means for a graphical image;

memory for storing a graphical image; and, an editing means for transforming one graphical image into another.

7. A method as in claim 5, wherein:

the editing step for transforming one graphical image into another comprises a graphics processing semiconductor chip with ROM-encoded software.

8. A device as in claim 6, wherein:

the editing means for transforming one graphical image into another comprises a graphics processing semiconductor chip with ROM-encoded software.

9. A method as in claim 1, wherein the step for applying said output to the bottom face of the footwear sole to create therein a mirror image comprises:

using a laser to etch said mirror image into the bottom face.

10. A device as in claim 2, wherein the means for applying said output to the bottom face of the footwear sole to create therein a mirror image comprises:

using a laser to etch said mirror image into the bottom face.

11. A method as in claim 1, wherein the step for applying said output to the bottom face of the footwear sole to create therein a mirror image comprises:

using a chemical reaction to etch said mirror image into the bottom face.

12. A method as in claim 1 wherein the step for applying said output to the bottom face of the footwear sole to create therein a mirror image comprises:

using mechanical impression to impress said mirror image into the bottom face.

13. A device as in claim 2, wherein the means for applying said output to the bottom face of the footwear sole to create therein a mirror image comprises:

using mechanical impression to impress said mirror image into the bottom face.

14. A method as in claim 1 wherein the step for applying said output to the bottom face of the footwear sole to create therein a mirror image comprises:

using heat to brand said mirror image into the sole.

15. A method as in claim 14, wherein the step for producing on the bottom face of the footwear sole said mirror image, by using heat to brand said image into the sole, further comprises:

having the step for producing an output of said image produce as that output a microwave-absorbing material in the shape of said image, attaching temporarily said output to the bottom face of the footwear sole, placing the footwear sole and output into a microwave, and turning on the microwave for a period of time to create heat in the output, thereby branding the mirror image into the bottom face of said footwear sole.

16. A device as in claim 2, wherein the means for applying said output to the bottom face of the footwear sole to create therein a mirror image comprises:

using heat to brand said mirror image into the sole.

17. A device as in claim 16, wherein the means for producing on the bottom face of the footwear sole said mirror image, by using heat to brand said image into the sole, further comprises:

having the means for producing an output of said image produce as that output a microwave-absorbing material in the shape of said image, attaching temporarily said output to the bottom face of the footwear sole, placing the footwear sole and output into a microwave, and turning on the microwave for a period of time to create heat in the output, thereby branding the mirror image into the bottom face of said footwear sole.

18. A method as in claim 1, further comprising:

including in the footwear means for applying ink to the bottom face of the sole where the mirror image of the pattern has been created, thereby allowing the user to print the pattern onto non-impressionable surfaces.

19. A method as in claim 1, further comprising:

including in the footwear means for applying ink to the bottom face of the sole where the inverse image of the pattern has been created, thereby allowing the user to print the pattern onto non-impressionable surfaces.

* * * * *